United States Patent [19]

Pfeifer et al.

[11] 4,061,915

[45] Dec. 6, 1977

[54] METHOD AND APPARATUS FOR MAKING X-RAY IMAGES

[75] Inventors: Josef Pfeifer, Unterhaching; Alfred Rheude; Jürgen Müller, both of Munich, all of Germany

[73] Assignee: AGFA-Gevaert Aktiengesellschaft, Leverkusen, Germany

[21] Appl. No.: 693,912

[22] Filed: June 8, 1976

[30] Foreign Application Priority Data

June 13, 1975 Germany ..... 2526415

[51] Int. Cl.[2] ..... G03G 15/00

[52] U.S. Cl. ..... 250/315 A

[58] Field of Search ..... 250/315 R, 315 A

[56] References Cited

U.S. PATENT DOCUMENTS

| | | | |
|---|---|---|---|
| 3,650,620 | 3/1912 | Hoyt | 250/315 A |
| 3,788,844 | 1/1974 | Sato et al. | 250/315 R |
| 3,873,832 | 3/1975 | Eseke et al. | 250/315 A |
| 3,920,991 | 11/1975 | Baker et al. | 250/315 R |
| 3,975,635 | 8/1976 | Lennon | 250/315 A |

*Primary Examiner*—Alfred E. Smith
*Assistant Examiner*—B. C. Anderson
*Attorney, Agent, or Firm*—Peter K. Kontler

[57] ABSTRACT

Sheet-like dielectric receptors which are to be exposed to object-modulated X-rays in the interelectrode gap of an ionography imaging chamber are attached to sheet-like carriers so that the carriers extend laterally beyond the reactors. The carriers are thereupon transported through the interelectrode gap and through successive stations of a xerographic printer which renders the latent imges of objects visible and subjects the receptors to other treatment. The carriers can be attached to receptors by resorting to an adhesive, by the application of electrostatic charges and/or by causing the marginal portions of the carriers to engage the receptors by suction. The carriers are provided with semiconductive layers whose surface resistance can be varied at or prior to entry of carriers and attached receptors into the various stations; this can be achieved by utilizing semiconductive layers whose resistance can be influenced by changing the pressure of the surrounding atmosphere or by utilizing photosensitive layers whose resistance changes in response to exposure to light. The layers are regenerated upon separation of finished receptors so as to allow for renewed use of the respective carriers.

40 Claims, 8 Drawing Figures

Fig. 4
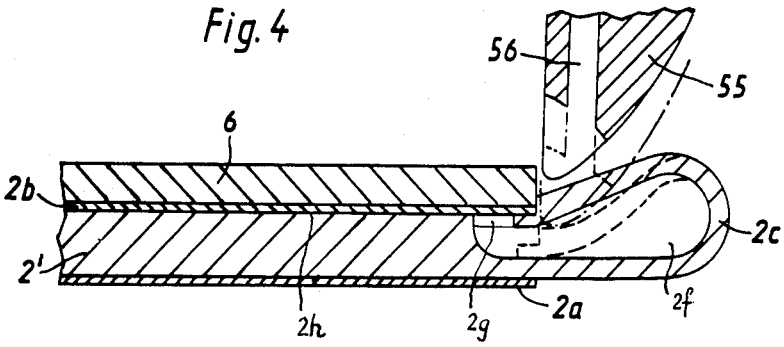
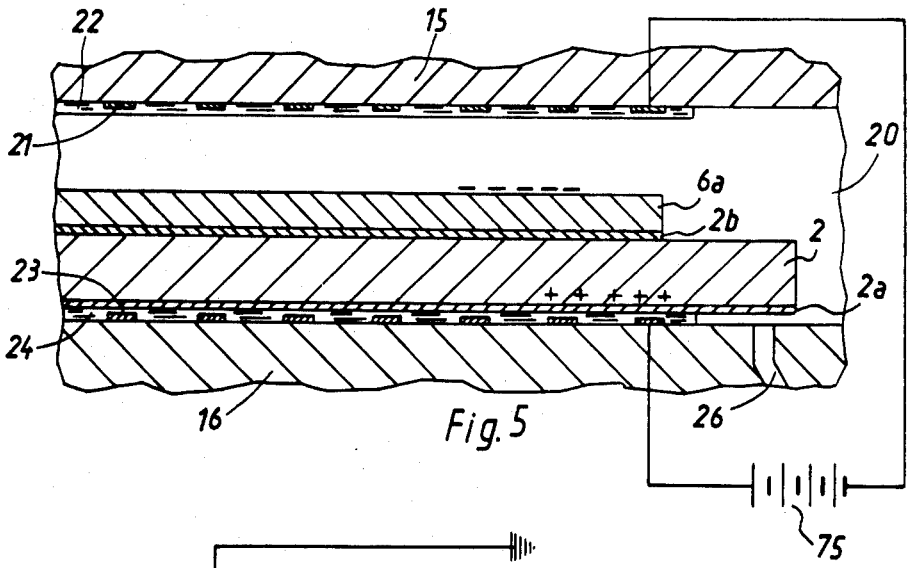
Fig. 5
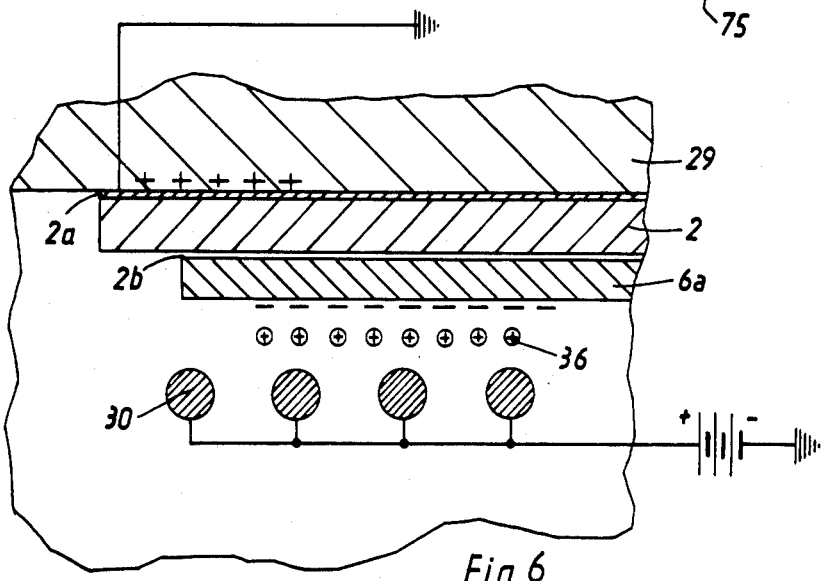
Fig. 6

METHOD AND APPARATUS FOR MAKING X-RAY IMAGES

BACKGROUND OF THE INVENTION

The present invention relates to a method and apparatus for making X-ray images. More particularly, the invention relates to improvements in a method and apparatus for making X-ray images without the use of conventional X-ray film. Still more particularly, the invention relates to a method and apparatus for making X-ray images on sheet-like dielectric receptors which are exposed to X-rays in the interelectrode gap of an ionography imaging chamber and are thereupon developed by resorting to xerographic techniques. The invention also relates to novel and improved means for supporting and advancing sheet-like receptors in the course of exposure to X-rays and during further processing.

It is known to produce latent images of objects on a sheetlike dielectric receptor while the receptor is located in the interelectrode gap of an ionography imaging chamber. The gap is filled with a compressed gaseous medium, preferably a noble gas, which is an efficient absorber of object-modulated X-rays and creates secondary electrons with the result that the receptor is provided with an electrostatic latent image which is thereupon made visible in a developing apparatus by using electrostatically attractible toner material. In the last stage, the toner image is fixed on the receptor in a manner known from the art of xerographic copying or printing.

A drawback of presently known methods and apparatus of the just outlined character is that the making of a fixed toner image takes up too much time. Dielectric receptors are introduced into and removed from the imaging chamber by hand. Also the transfer of receptors, which carry latent images, to and from further processing (developing and fixing) stations is effected by hand. Automatic transport of such receptors was considered impractical or impossible because an X-ray image is normally without margins (i.e., the image covers the entire exposed side of the receptor) so that the transporting means would have to engage those areas of a receptor which are contacted by toner material. The provision of an unexposed margin on receptors (which margin could be engaged and moved by an automatic transporting mechanism) is undesirable because the margin would have to be removed upon completion of treatment and the removed material would represent a highly expensive waste which would have to be processed (disposed of) in a costly and time-consuming manner. Moreover, the provision of margins would complicate the making of X-ray images on sheets with rounded corners which are preferred by technicians and physicians due to convenience of manipulation and storage.

SUMMARY OF THE INVENTION

An object of the invention is to provide a novel and improved method of making X-ray images on sheet-like dielectric receptors which are exposed to X-rays in an ionography imaging chamber and are thereupon developed by xerographic techniques.

Another object of the invention is to provide a method which renders it possible to expose and develop successive receptors of identical size and/or different size and/or shape in a fully automatic or semiautomatic way and at a speed which greatly exceeds the speed of making X-ray images in accordance with conventional methods.

A further object of the invention is to provide a novel and improved apparatus which can be utilized for the practice of the above outlined method and which is sufficiently versatile to allow for exposure and other treatment of larger, smaller, similar and/or differently configurated receptors.

An additional object of the invention is to provide novel and improved means for supporting and transporting receptors through the exposure, development and other stations of the apparatus.

Still another object of the invention is to provide an apparatus which requires a minimum of attention and which can be used for the making of X-ray images without margins and with rounded edges on the respective receptors.

Another object of the invention is to provide a novel carrier for transport of receptors through the improved apparatus.

A further object of the invention is to provide a carrier which can be reused as often as desired, which can properly support and move receptors of any practical size and/or shape, and whose presence does not affect the exposure and/or other treatment of receptors during the making of X-ray images.

An ancillary object of the invention is to provide a novel and improved method of attaching the carrier to a receptor and a novel and improved method and device for separating receptors from the respective carriers.

A further object of the invention is to provide the apparatus with novel and improved means for attaching receptors to carriers prior to introduction of receptors into the imaging chamber.

One feature of the invention resides in improvements in a method of making X-ray images on sheet-like dielectric receptors which are exposed to X-rays in the interelectrode gap of an ionography imaging chamber to produce thereon latent images of selected objects, such latent images being thereupon made visible by xerographic techniques (by resorting to a suitable toner material) at a developing station. The improvements include the steps of attaching each receptor (the receptors may be of identical size or of different sizes) to a discrete sheet-like carrier which is at least partially conductive and extends beyond the respective receptor, and transporting the thus attached receptors seriatim in a predetermined direction toward, through and past the imaging chamber and developing station by way of the respective carriers. If the developing step includes contacting the image-bearing surfaces of receptors with toner material (which can be distributed in a liquid carrier medium), the method normally comprises treating each receptor (with a visible image thereon) at a fixing station. The improvements then preferably further comprise the step of transporting the receptors from the developing station toward and through (and preferably beyond) the fixing station through the medium (i.e., by way) of the respective carriers.

Each carrier preferably extends at least beyond two opposite sides of the respective receptor and transversely of the direction of transport, and each transporting step preferably comprises advancing the receptors by transmitting motion (e.g., by means of rollers, rolls and/or belts) to those portions of the carriers which extend beyond the respective receptors.

The attaching step may comprise temporarily securing the receptors to the respective carriers by the application of suction to such parts (e.g., to hollow marginal beads) of the carriers which are adjacent to the marginal portions of the respective receptors to thereby hold the aforementioned parts in engagement with the associated receptors. Alternatively, the attaching step may comprise applying electrostatic charges to the carriers and the respective receptors. Still further, the attaching step may comprise bonding the receptors to the respective carriers by films of a highly viscous liquid. The carriers can be secured to the receptors by resorting to two or more different attaching steps, e.g., by electrostatic charging and by the application of adhesive films.

The other side of each carrier may be provided with a layer of semiconductive material. Such layers are subjected to elevated gas pressure (preferably to the pressure of a noble gas) during exposure of the respective receptors to X-rays in the interelectrode gap of the imaging chamber, and to substantially atmospheric pressure during transport through the developing station; this changes the surface resistance of the layer at the respective stations.

The layers of the carriers may consist of photoconductive material, and the improvements then preferably further comprise the steps of shielding such layers from light prior to transport of the carriers into and during dwell of the carriers in the interelectrode gap, and thereupon exposing the layers to light (e.g., daylight and/or ultraviolet light) not later than at the developing station (i.e., during transport between the gap and the developing station or at the developing station proper).

The carriers are separated from the respective receptors subsequent to transport through the developing station (preferably subsequent to transport through the aforementioned fixing station), and the semiconductive layers of the thus separated carriers are preferably subjected to a regenerating treatment (e.g., heating) so that the carriers can be attached to fresh receptors for renewed transport toward, through and beyond the interelectrode gap, developing station and fixing station.

The novel features which are considered as characteristic of the invention are set forth in particular in the appended claims. The improved apparatus itself, however, both as to its construction and its mode of operation, together with additional features and advantages of the carrier, will be best understood upon perusal of the following detailed description of certain specific embodiments with reference to the accompanying drawing.

BRIEF DESCRIPTION OF THE DRAWING

FIG. 4 is a fragmentary sectional view of a modified device for attaching receptors to carriers;

FIG. 5 is an enlarged sectional view of a portion of the imaging chamber in the apparatus of FIG. 1; and FIG. 6 is an enlarged sectional view of a portion of the developing unit in the apparatus of FIG. 1.

DESCRIPTION OF THE PREFERRED EMBODIMENTS

Figure 1:
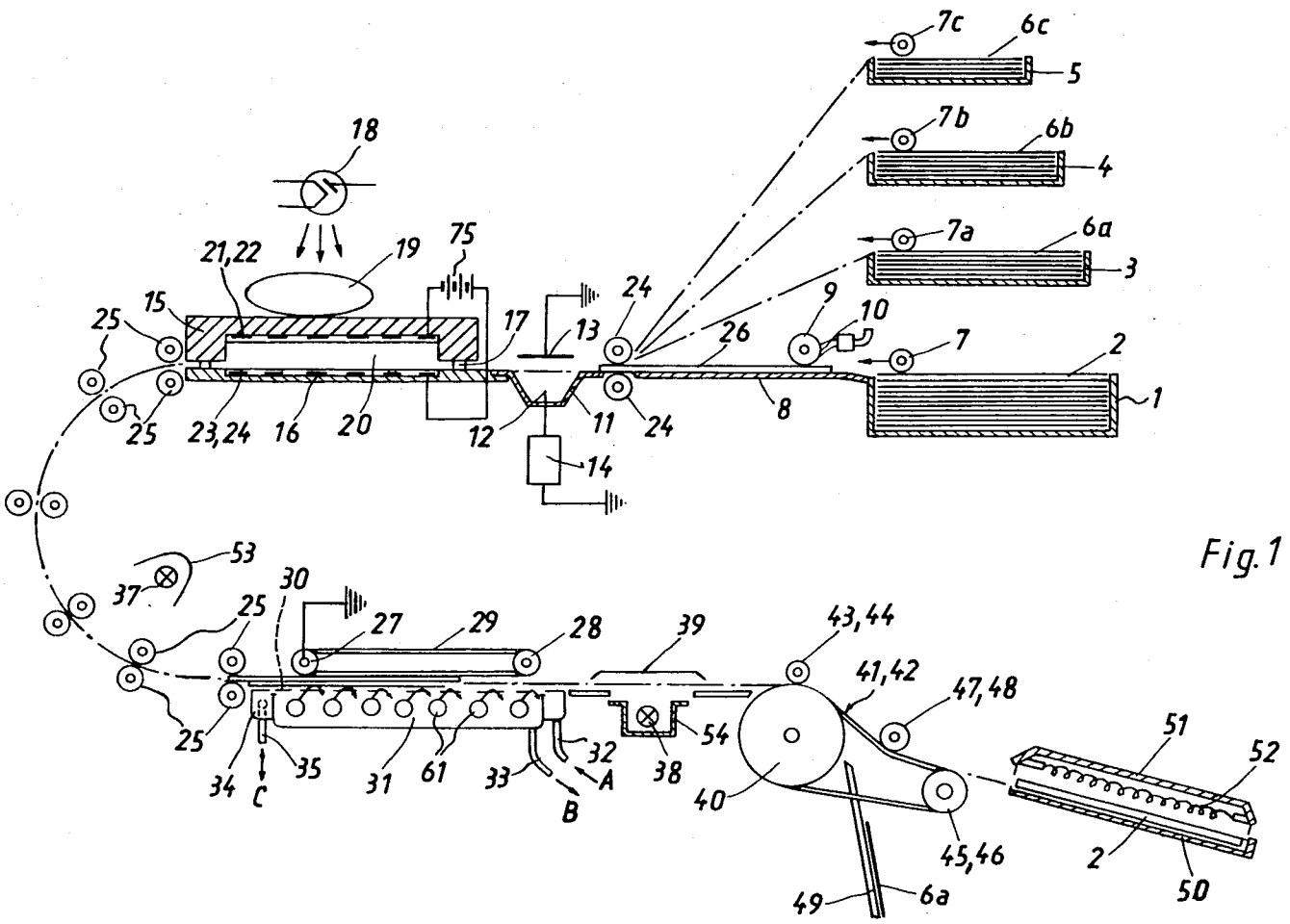
FIG. 1 is a schematic partly elevational and partly sectional view of an apparatus which embodies the invention.

FIG. 1 shows an apparatus wherein a tray or an analogous receptacle 1 stores a supply or stack of sheet-like flexible carriers 2. Additional trays or receptacles 3, 4, 5 are provided for storage of stacks of sheet-like dielectric receptors **6*a*, 6*b*, 6*c* of different sizes. The apparatus further comprises means (e.g., driven feed rolls 7, 7*a*, 7*b*, 7*c*) for respectively drawing discrete carriers 2 and receptors 6*a*, 6*b*, 6*c* from the corresponding trays 1, 3, 4 and 5. When a receptor 6*a*, 6*b* or 6*c* is to be exposed to object-modulated X-rays, a carrier 2 is advanced onto a platform 8 prior to or simultaneously with advancement of a receptor 6*a*, 6*b* or 6*c* so that the selected receptor overlies the carrier. On its way from the tray 1 toward and onto the platform 8, each carrier 2 advances below a paster having a roller-shaped applicator 9 and a nozzle or wick 10 which delivers a layer or film of a highly viscous liquid to the periphery of the applicator 9. The latter transfers the film onto a predetermined portion of the upper side of the moving carrier 2. The nature of liquid is such that it causes the selected receptor 6*a*, 6*b* or 6*c* to adhere to the carrier 2 as well as to establish a satisfactory electrical connection between the overlapping sheet-like components on the platform 8**.

Figure 3:
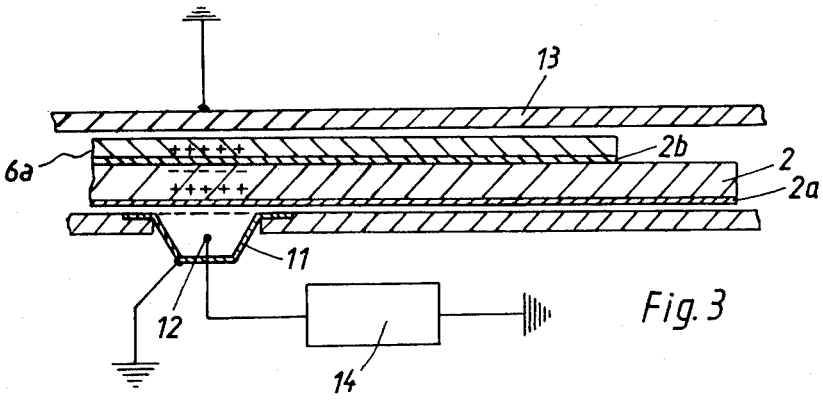
FIG. 3 is an enlarged sectional view of a corona discharge device in the apparatus of FIG. 1.

The platform 8 is followed (as considered in the direction of transport of the carrier 2 and a selected receptor **6*a*, 6*b* or 6*c*) by a corona discharge device through which the laminated structure or sandwich including a carrier and a receptor is advanced by means of two pairs of transporting rolls 24 located immediately downstream of the platform. As shown in FIG. 3, the corona discharge device comprises a grounded housing 11 which confines a wire-like discharge electrode 12. The electrode 12 is located opposite a grounded electrode 13 and is connected to a high-voltage power supply 14**.

FIG. 3 further shows that the carrier 2 (whose main or first layer preferably consists of polypropylene with a specific resistance of $10^{12}$–$10^{13}$ ohms per unit area) comprises a second or backing layer **2*a* of semiconductive material, preferably amorphous selenium. It is equally possible to resort to a different backing layer which is a semiconductor (photoconductor) and has a dark resistance of at least but preferably more than $10^9$ ohms per unit area. The reference character 2*b* denotes the film of highly viscous liquid which is applied by the paster 9, 10 of FIG. 1. This liquid may be glycerine or silicone oil whose electric resistance is lower than that of a receptor 6*a*, 6*b* or 6*c*, e.g., by admixing thereto a comminuted conductive substance such as graphite powder. During travel of a sandwich through the corona discharge device, the electrodes 12, 13 apply to the carrier 2 and the receptor (e.g., 6*a*) potentials in a manner as shown in FIG. 3. The electrostatic forces which develop as a result of such charging of the components 2, 6*a* cause the latter to adhere to the former. Such adherence is in addition to that which is caused by the adhesive film 2*b***.

The thus treated sandwich consisting of receptor 6a and carrier 2 (to which the receptor adheres) is advanced into the ionography imaging chamber a portion of which is shown on a larger scale in FIG. 5. This chamber comprises a first or upper section 15 and a second or lower section 16. The sections 15, 16 are connected to each other with interposition of a sealing element 17 (see FIG. 1). Reference may be had to our copending application Ser. No. 666,410 filed Mar. 12, 1976; the matter of the copending application is incorporated herein by reference. The sections 15, 16 define an interelectrode compartment or gap 20 which is surrounded by the sealing element 17 and contains a supply of compressed noble gas or Freon. The manner in which the gas can be introduced into the gap 20 is disclosed in our copending application Ser. No. 666,410 and also in U.S. Pat. No. 3,774,029 granted Sept. 20, 1973 to Muntz et al. The gas in the gap 20 absorbs the X-rays which issue from a source 18 and penetrate through or pass around an object 19 (both shown in FIG. 1) with attendant ionization of the gas. The pressure of gas in the compartment 20 is reduced prior to introduction of a sandwich 2, 6a or 2, 6b or 2, 6c. FIG. 5 shows a channel 26 which is provided in the section 16 and is connected to a gas evacuating pump, not shown. The pump feeds the evacuated gas into a suitable storage vessel.

A sandwich 2, 6a or 2, 6b or 2, 6c can be introduced into and removed from the gap 20 upon deflation of the sealing element 17. Such inflatable sealing element is disclosed in our copending application Ser. No. 666,410. When inflated, the sealing element 20 engages the carrier 2 in regions surrounding the attached receptor 6a, 6b or 6c.

The gap 20 is flanked by electrodes 21 and 23 which are connected to an external 15,000 volt energy source 75. The electrodes in the space between the sections 15, 16 of the imaging chamber are so-called virtual electrodes of the type disclosed, for example, in U.S. Pat. No. 3,859,529 granted Jan. 27, 1975 to Proudian et al. The electrodes 21, 23 are respectively surrounded by semiconductors 22, 24 having a dark resistance $10^9$ ohms per unit area. An electrostatic latent image develops at the exposed side of the receptor 6a as a result of deposition of ions which develop in the gap 20 due to the influence of the accelerating potential difference applied between the electrodes 21 and 23.

When the ionization imaging chamber comprises virtual electrodes, the surface resistance of the semiconductor layer 2a must exceed the surface resistance of the adjacent electrode (23 in FIG. 1 or 5) by a factor of 10–100 in order to insure that a transverse current of predetermined strength can flow along the electrode. The resistance of the material which is normally used for the making of virtual electrodes is approximately $10^8$ ohms per unit area. Therefore, the resistance of the layer 2a should be in the range of $10^9$–$10^{10}$ ohms per unit area. On the other hand, the deposition of toner particles on the exposed receptor (i.e., the equalization of charges which is a necessary adjunct of such deposition) is promoted if the resistance of the layer 2a during travel of the respective sandwich through the developing unit does not exceed $10^6$ ohms per unit area.

In order to prevent sparking during separation of an exposed receptor from the electrode 23, the receptor must be separated from the electrode together with the respective layer (whose charge is mirror symmetrical to the charge representing the latent image on the receptor). Thus, and in the absence of a layer whose charge can be changed from station to station, it would be necessary to apply to the carrier 2 a first layer 2a (with a first conductivity) at the exposure station and a layer of different second conductivity at the developing station. The semiconductive layer 2a of the improved carrier renders this unnecessary because it can be influenced by external means prior to entering the exposure station and the developing station so that it exhibits optimum electrical characteristics for the treatment of associated receptor at the respective station.

It would be conceivable to apply a semiconductive layer directly to the rear sides of the receptors 6a, 6b and 6c. However, the provision of semiconductor layer 2a at the rear sides of carriers 2 exhibits the advantage that its material can be selected by disregarding its appearance. Thus, if the semiconductor layers 2a were applied to the receptors, they would have to be made of light-transmitting material which would greatly reduce the number of available materials. In accordance with the present invention (according to which the layers 2a are applied to the carriers rather than to the receptors), the only important consideration in connection with selection of the material of receptors is to insure that such material exhibits optimum characteristics for exposure to X-rays and for subsequent development of latent images by xerographic techniques. For example, each receptor 6a, 6b or 6c may constitute a transparent sheet consisting of polyester.

The exposed receptor 6a (which continues to adhere to the carrier 2) is removed from the imaging chamber by the first of several sets of transporting rolls 25 to enter a developing unit. The first or foremost rolls 25 engage the lateral marginal portions at the leading end of the carrier in the gap 20 and move the sandwich into the range of the next-following rolls 25. The leader of the sandwich 2, 6a is then engaged and advanced by the adjacent reach or stretch of a belt conveyor 29 which is trained over pulleys 27, 28 and engages the backing layer 2a of the carrier. The conveyor 29 moves the receptor 6a past an apertured developing electrode 30 (FIG. 6) which is mounted at the top of a trough or vessel 31. The latter contains a battery of nozzles 61 which discharge streams of developing material in directions indicated by arrows. Such material passes through the apertures of the electrode 30 and continuously contacts the latent image at the exposed side of the receptor 6a. The arrangement of nozzles 61 insures that the receptor 6a is constantly contacted by fresh developer material. The nozzles 61 receive developer by way of a conduit 32 which is connected to a suitable source by way of a pump, not shown, serving to convey fresh developer in the direction indicated by arrow A. A suction pipe 33 serves to evacuate spent developer from the trough 31 in the direction indicated by arrow B. Thus, the trough 31 contains a body of developer which continuously receives fresh material via conduit 32 and continuously supplies material to the source via pipe 33.

The trough 31 is surrounded by a further vessel 34 which intercepts and collects liquid developer overflowing the edges of the trough 31. The outlet of the collecting vessel 34 is connected with the source by a pipe 35 which conveys the liquid in the direction indicated by arrow C.

The electrical properties of the layers 2a are influenced by subjecting such layers to different pressures. Thus, the layers 2a are subjected to superatmospheric pressure of a high Z gas during dwell of the respective carriers in the interelectrode gap 20, and the pressure is reduced to atmospheric pressure during treatment of receptors at the developing station between the conveyor 29 and electrode 30. The elevated pressure in the gap 20 brings about a temporary rise in surface resistance of the layers *2a*, and such resistance reassumes its normal (lower) value during treatment of receptors in the developing unit where the pressure of air at the exposed sides of layers *2a* equals or approximates atmospheric pressure.

If the layers *2a* consist of photosensitive material, the carriers 2 are shielded from light prior to entry into and during dwell in the interelectrode gap 20, and are exposed to daylight and/or ultraviolet light on their way toward and/or at the developing station (see the lamp 37 of FIG. 1 which illuminates the layers *2a*). Regeneration of such photosensitive material can be effected at the station including the heating coils 52, i.e., by the application of heat. This reduces the surface resistance of the layers by a factor of 10 to 100. The number of carriers which must be stacked in the tray 1 of FIG. 1 (and whose layers *2a* consist of photoconductive material) depends on the maximum number of exposures to be made during the interval which is required for regeneration of a layer in the tray 50. As soon as a layer is regenerated, the respective carrier can be transferred or transported from the tray 50 and back into the tray 1. Such mode of manipulating the carriers insures that the apparatus can operate properly and with a high output by utilizing a relatively small number of carriers.

Regardless of whether the layers *2a* consist of a photoconductive or other material, the electrical resistance of the first or main layers of the carriers 2 preferably equals or approximates the maximum resistance of the respective layers *2a*.

FIG. 6 shows in greater detail the conditions prevailing in the developing unit during development of a latent image. The liquid developer which is supplied by the orifices of the nozzles 61 contains positively charged toner particles 36 which migrate toward the negatively charged portions of the image-bearing exposed surface of the receptor *6a*. The conveyor 29 consists of electrically conductive material and is connected to the ground. The resulting equalization of charges renders it necessary to remove a portion of the mirror symmetrical charges which are applied to other conductive layers of the sandwich. In order to insure rapid removal of such charges, each photosensitive layer *2a* travels along a light source 37 (FIG. 1) on its way toward the developing station; this enhances the conductivity of the backing layer. The light source 37 is mounted in front of a reflector 53.

The sandwich which issues from the developing unit including the electrode 30 is advanced past an infrared lamp 38 which is mounted in a housing 54 and is located opposite a reflector 39 in order to reduce radiation losses. The parts 38, 39 form a fixing unit for the developed image on the receptor *6a;* this unit causes evaporation of solvent in the developing liquid which is supplied by the nozzles 61 with attendant softening of the resinous ingredient of the carriers of coloring matter, i.e., the receptor *6a* is provided with a fixed toner image.

Figure 2:
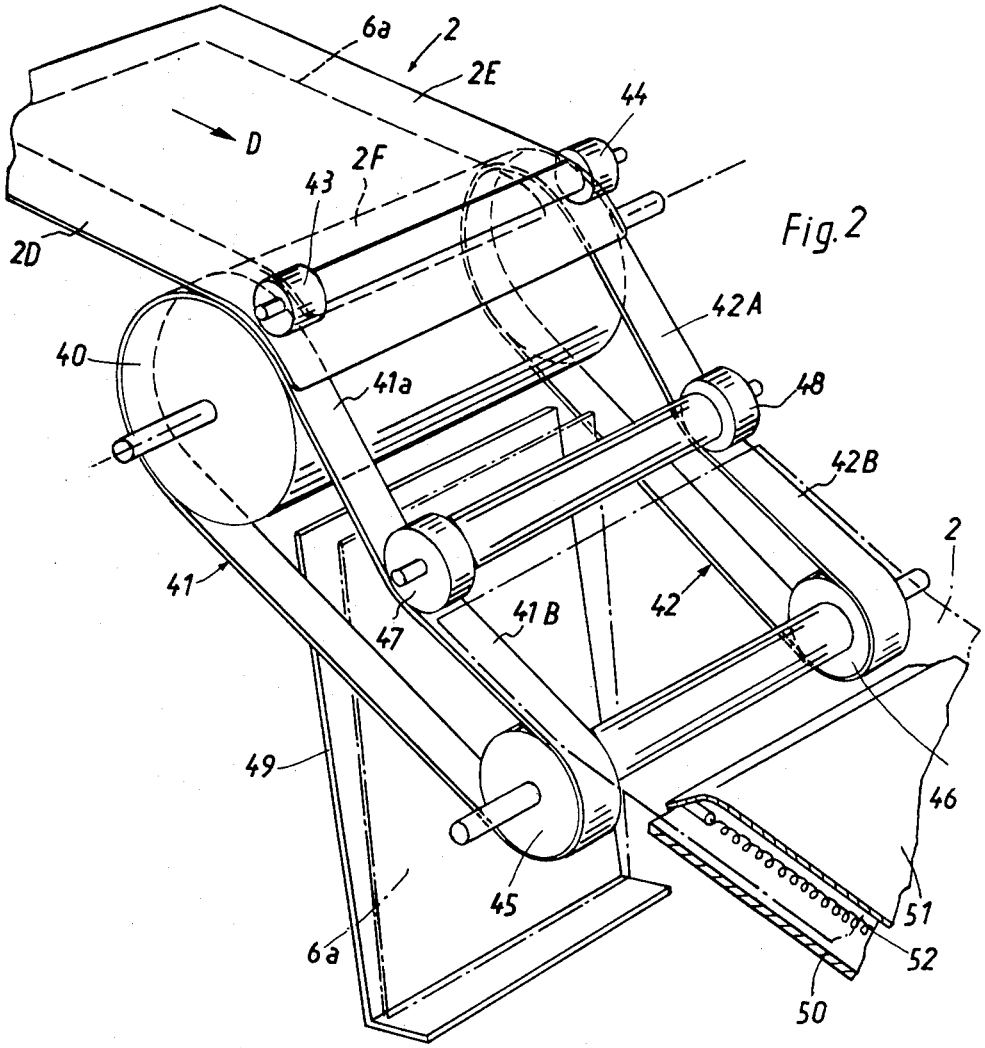
FIG. 2 is an enlarged perspective view of a device which forms part of the apparatus of FIG. 1 and is used to separate receptors from their carriers.

The sandwich 2, *6a* then enters a separating or peeling unit, shown in FIG. 2, wherein the receptor *6a* is separated from its carrier 2. The direction of movement is indicated by arrow D. The leader of the sandwich enters the nips between two endless bands 41, 42 (which are trained over a front roller 40 and rear rollers 45, 46) and biasing rolls 43, 44 located opposite the roller 40. The bands 41, 42 are tensioned by rolls 47, 48 so that the upper reach of each of these bands includes two mutually inclined portions 41A, 41B and 42A, 42B. The width of the carrier 2 exceeds the width of the receptor *6a*, i.e., the marginal portions of the carrier travel with the upper reaches of the bands 41, 42 and the receptor *6a* is located in the space between such bands. Consequently, the receptor *6a* is separated from the carrier 2 in the region where the carrier is flexed by the biasing rolls 47, 48 and becomes separated from the receptor *6a* which descends into a collecting tray 49. The carrier 2 advances into a separate tray 50. The latter is located adjacent to (e.g., below) a set of heating coils 52 disposed in front of a reflector 51 and serving to effect rapid regeneration of the backing layer *2a*. The layer *2a* is relieved of the remnant of its charge and rapidly reassumes its dark conductivity. The carrier 2 is then ready for transfer (or transport) back into the tray 1.

The tensioning rolls 47, 48 are preferably positioned in such a way that they cause successive increments of a carrier 2 to assume an arcuate shape with a relatively small radius of curvature. This enhances the separation of the receptor. The thus separated receptor descends by gravity in the space between the bands 41 and 42.

FIG. 2 shows that the carrier 2 has two marginal portions 2D, 2E which extend beyond two opposite sides of the receptor *6a* and transversely of the direction of transport (arrow D) of the carrier along the path extending from the tray 1, through the imaging chamber, the developing station and the fixing station. The marginal portions 2D, 2E are elongated strips which are parallel to the direction of movement of the carrier 2. The rolls 24, 25 and 43, 44 engage the marginal portions 2D, 2E of the carrier 2, i.e., such rolls move the receptor *6a* exclusively through the medium of the carrier. This renders it possible to make X-ray images which are without margins and exhibit rounded corners for convenience of handling and storage.

FIG. 2 further shows that the marginal portion 2F at the leading end of the carrier 2 extends beyond the leader of the receptor *6a*. This is desirable for convenient separation of the two sheets while the carrier 2 is advanced by the bands 41, 42.

The carrier 2 may but need not be rectangular or square; all that counts is to insure that the carrier extends beyond the largest receptor and that it be at least slightly conductive. The configuration of the receptors *6a, 6b, 6c* can also deviate from a rectangular or square shape, as long as the receptors are smaller than the carrier Z so that the latter extends beyond the attached receptor and its non-overlapped portions can receive motion from rolls, wheels, bands and/or other suitable transporting elements.

Conductivity of the carriers 2 is desirable and advantageous because it allows for continuous adherence of carriers to the respective receptors during each stage of treatment which is needed to form latent images, to render the images visible and to fix the developed images on the receptors. The thickness of the first or main layer of a carrier may be between 180 and 400$\mu$.

FIG. 4 shows a carrier 2' which is formed with a circumferentially complete hollow marginal bead *2c*. The marginal bead *2c* can be depressed and deformed by a suitable mandrel 55 in such a way and to such an extent that its interior communicates with a channel 56 which is provided in the mandrel and is connected to a suction generating device, not shown. The resulting vacuum in the interior of the bead 2c causes the latter to bear against the adjacent marginal portions of the receptor 6 (this receptor may be any one of the receptors 6a, 6b, 6c shown in FIG. 1) with the result that the receptor is attached to the carrier 2'. At the separating station, the bead 2c is engaged by another mandrel which admits air into the interior of the bead so that the latter becomes separated from the exposed and developed receptor and the receptor becomes separated from the carrier 2'. The mandrel 55 can be movably mounted in the region of the platform 8 of FIG. 1.

Figures 4A, 4B:
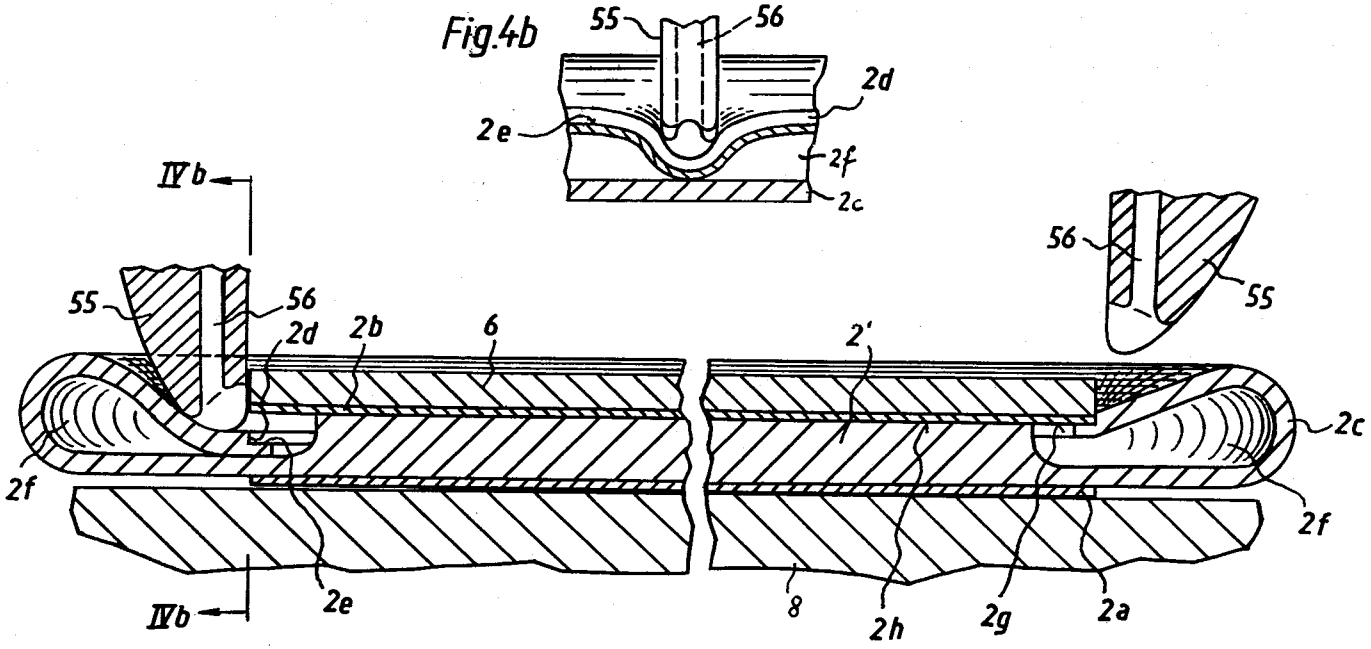
FIG. 4*a* illustrates the device of FIG. 4, the right-hand portion showing the marginal bead of the carrier in a position it assumes when the receptor is attracted to the carrier by suction, and the left-hand portion showing the manner in which the receptor can be attached to or detached from the carrier.
FIG. 4*b* is a sectional view as seen in the direction of arrows from the line IVb—IVb of FIG. 4*a;*

FIGS. 4 and 4a further show that the free edge portion of the bead 2c has a circumferentially complete cutout bounded by surfaces 2d and 2e. This cutout is outwardly adjacent to an opening 2g which communicates with the internal space 2f of the bead 2c. The reference character 2h denotes the exposed underside of the film 2b. The bead 2c is elastic but is sufficiently stiff to insure that the surface 2e abuts agaist the adjacent portion of the underside 2g prior as well as subsequent to evacuation of some air from the opening 2g and space 2f. Minor uneveness of the underside 2h and/or surface 2e are compensated for by elasticity of the bead portion below the surface 2e.

If the mandrel 55 evacuates some air from the space 2f, the resulting drop of pressure in the interior of the bead 2c need not be sufficiently pronounced to effect any deformation of the bead. However, the drop of pressure is felt in the gap (if any) between the upper side of the central portion of the carrier 2' and the underside 2h of the receptor 6 whereby the receptor is attracted to the carrier. The just mentioned gap communicates with the space 2f by way of the opening 2g. It has been found that the evacuation of relatively small quantities of air from the space 2f suffices to insure that the carrier attracts the receptor with a considerable force.

When the mandrel 55 is moved to the position shown in the left-hand portion of FIG. 4a (such position corresponds to the phantom-line position of the mandrel 55 in FIG. 4), a relatively small portion of the bead 2c is deformed whereby the channel 56 communicates with a portion of the space 2f. As shown in FIG. 4b, the deformation of the bead 2c is such that the exchange of air between the channel 56 and space 2f takes place only in the region of that part of the free edge portion of the bead which is actually deformed by the mandrel 55. This renders it possible to control the extent to which air is evacuated from the space 2f and hence the force with which the receptor is attracted to the carrier. If the channel 56 communicates with the atmosphere or with a source of compressed gaseous fluid, the establishment of communication between the channel 56 and the space 2f results in a weakening of the force which attracts the receptor to the carrier. If the channel 56 communicates with a suction generating device (such mandrel is located in the region of the platform 8), the pressure in the opening 2g and space 2f decreases whereby the carrier attracts the receptor with a greater force.

This film 2b can be omitted if the receptor 6 is secured to the carrier in a manner as shown in FIGS. 4, 4a and 4b.

It is further within the purview of the invention to resort to other techniques and means for attaching receptors 6a, 6b or 6c to their carriers. For example, one side of each carrier can be provided with a film of adhesive (such as by resorting to the paster 9, 10 of FIG. 1) which can be used once or more than once and is renewed when necessary, i.e., whenever the carrier is removed from the tray 1 or after each second, third, etc. transport of the carrier through the apparatus of FIG. 1. However, it is preferred at this time to attach the receptors to their carriers in a manner as described in connection with FIG. 4 and/or by applying electrostatic charges and films of adhesive in a manner shown in FIGS. 1 and 3. The highly viscous adhesive (e.g., glycerine, silicone oil or the like) which is dispensed by the nozzle 10 of FIG. 1 exhibits the advantage that it establishes an intimate electrical contact between the carrier and the respective receptor.

The apparatus of FIG. 1 can be readily combined with a suitable control system which can automatically start the feed roll 7a, 7b or 7c, depending upon the size of the object 19, and which can start the feed roll 7 at an appropriate time to insure proper attachment of the thus withdrawn carrier to a receptor 6a, 6b or 6c. Such control system preferably allows for withdrawal of two or more identically dimensioned receptors (one after the other) or for withdrawal of differently dimensioned receptors in any desired sequence.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. In a method of making X-ray images on sheet-like dielectric receptors which are exposed to object-modulated X-rays in the interelectrode gap of an ionography imaging chamber to produce thereon latent images which are made visible by xerographic techniques at a developing station, the steps of separably attaching each receptor to one side of a discrete sheet-like carrier which is at least partially conductive and extends beyond the respective receptor; and individually transporting the thus attached receptors in a predetermined direction toward, through and past said imaging chamber by way of the respective carriers.

2. In a method as defined in claim 1, the additional step of transporting the receptors toward and through said developing station by way of the respective carriers.

3. In a method as defined in claim 2, wherein the receptors are treated at a fixing station subsequent to treatment at said developing station, the additional step of transporting the receptors from said developing station toward and through said fixing station by way of the respective carriers.

4. In a method as defined in claim 2, wherein each carrier extends beyond two opposite sides of the respective receptor and transversely of said direction, said transporting step comprising advancing the receptors by transmitting motion to those portions of the carriers which extend beyond the respective receptors.

5. In a method as defined in claim 2, wherein said attaching step comprises temporarily securing the receptors to the respective carriers by the application of subatmospheric pressure to such parts of the carriers which are adjacent to the edges of the respective receptors.

6. In a method as defined in claim 2, wherein said attaching step comprises applying electrostatic charges to the carriers and the respective receptors.

7. In a method as defined in claim 2, wherein said attaching step comprises bonding the receptors to the respective carriers by films of a highly viscous liquid.

8. In a method as defined in claim 7, wherein said liquid is selected from the group consisting of silicone oil and glycerine.

9. In a method as defined in claim 2, wherein the other side of each carrier is provided with a layer of semiconductive material.

10. In a method as defined in claim 9, the additional steps of subjecting the semiconductive layers to elevated gas pressure during exposure of the respective receptors in said gap and subjecting said layers to substantially atmospheric pressure during transport through said developing station.

11. In a method as defined in claim 9, wherein each layer consists of photoconductive material, the additional steps of shielding said layers from light prior to transport of the respective carriers into and during dwell of such carriers in said gap, and thereupon exposing said layers to light not later than at said developing station.

12. In a method as defined in claim 11, wherein said light is visible light.

13. In a method as defined in claim 11, wherein said light is ultraviolet light.

14. In a method as defined in claim 9, the additional step of separating the carriers from the respective receptors subsequent to transport of carriers through said developing station.

15. In a method as defined in claim 14, the additional step of subjecting the layers of separated carriers to a regenerating treatment.

16. In a method as defined in claim 15, wherein said treatment includes heating the carriers.

17. Apparatus for making X-ray images on sheet-like dielectric receptors, comprising an ionography imaging chamber having an interelectrode gap wherein the receptors are exposed to object-modulated X-rays to provide thereon latent electrostatic images of objects; a developing unit having means for contacting exposed receptors with toner to thereby convert said latent images into visible images; means for fixing said visible images; a source of discrete sheet-like flexible carriers larger than said receptors; at least one source of discrete receptors; means for withdrawing discrete carriers and receptors from the respective sources; means for separably attaching the withdrawn carriers to withdrawn receptors whereby at least one portion of each carrier extends beyond the attached receptor; and means for transporting the carriers and the attached receptors in a predetermined direction toward and through said gap.

18. Apparatus as defined in claim 17, further comprising means for transporting said carriers and the attached receptors from said gap toward and through said developing unit.

19. Apparatus as defined in claim 18, further comprising means for transporting said carriers and the attached receptors from said developing unit toward, through and beyond said fixing unit.

20. Apparatus as defined in claim 18, further comprising means for separating the carriers from the respective receptors downstream of said developing unit.

21. Apparatus as defined in claim 20, further comprising discrete receptacles for collection of separated carriers and receptors.

22. Apparatus as defined in claim 20, wherein each carrier has a first side which is adjacent to the respective receptor and a second side provided with a semiconductive layer, and further comprising means for illuminating said layers of successive carriers intermediate said chamber and said developing unit.

23. Apparatus as defined in claim 22, further comprising means for regenerating said layers of separated carriers.

24. Apparatus as defined in claim 18, wherein said portion of each carrier extends laterally beyond the attached receptor, as considered in said direction, and said transporting means comprises elements which are adjacent to the path of movement of attached receptors and engage said portions of the respective carriers.

25. Apparatus as defined in claim 24, wherein said elements include driven rolls.

26. Apparatus as defined in claim 24, wherein said elements include at least one belt conveyor.

27. Apparatus as defined in claim 18, wherein said attaching means includes a paster arranged to apply a film of viscous liquid to that side of each carrier which is to adhere to the respective receptor.

28. Apparatus as defined in claim 18, wherein said attaching means includes means for applying electrostatic charges to the carriers and the respective receptors.

29. Apparatus as defined in claim 28, wherein said applying means comprises a corona discharge device.

30. Apparatus as defined in claim 18, wherein said attaching means comprises means for connecting the carriers to the respective receivers by means of suction.

31. Apparatus as defined in claim 30, wherein each carrier has a circumferentially complete hollow bead and said connecting means includes means for evacuating air from the bead.

32. Apparatus as defined in claim 18, wherein each carrier comprises two marginal portions extending in said direction and beyond the attached receptor, and further comprising means for separating successive carriers from the respective receptors including transporting elements which engage said marginal portions of the carriers and means for flexing the thus engaged carriers with respect to and away from the respective receptors.

33. Apparatus as defined in claim 32, wherein said transporting elements are endless bands and said flexing means comprises devices for flexing said bands so that the flexed portions of said bands flex the carriers to impart to successive increments of carriers an arcuate shape with a relatively small radius of curvature.

34. As a novel article of manufacture, a flexible sheet-like carrier for transport of a single separably sheet-like dielectric receptor through apparatus wherein the receptors are exposed to object-modulated X-rays in the interelectrode gap of an ionography imaging chamber to form thereon latent images which are thereupon made visible by xerographic techniques, said carrier including a first layer and a second layer having a surface resistance which, during at least one stage of transport through said apparatus, is at least $10^9$ ohms per unit area.

35. A carrier as defined in claim 34, wherein said second layer is a photoconductor having a dark resistance in excess of $10^9$ ohms per unit area.

36. A carrier as defined in claim 34, wherein said second layer is a semiconductor which, when subjected to external superatmospheric gas pressure, exhibits a resistance in excess of $10^9$ ohms per unit area.

37. A carrier as defined in claim 36, wherein said first layer has a resistance which at least approximates the maximum resistance of said semiconductor.

38. A carrier as defined in claim 34, wherein said first layer consists of polypropylene.

39. A carrier as defined in claim 34, wherein the thickness of said first layer is 180–400$\mu$.

40. A carrier as defined in claim 34, wherein said first layer has a hollow marginal portion surrounding that area which is in contact with a dielectric receptor during transport of the carrier through said apparatus so that, on evacuation of air from such marginal portion, the latter engages and holds a receptor against the carrier.

* * * * *